US005175799A

United States Patent [19]

Shimura

[11] Patent Number: 5,175,799

[45] Date of Patent: Dec. 29, 1992

[54] SPEECH RECOGNITION APPARATUS USING PITCH EXTRACTION

[75] Inventor: Hiroshi Shimura, Yokohama, Japan

[73] Assignee: Ricoh Company, Ltd., Japan

[21] Appl. No.: 590,938

[22] Filed: Oct. 1, 1990

[30] Foreign Application Priority Data

Oct. 6, 1989 [JP] Japan ..... 1-261296

[51] Int. Cl.[5] ..... G10L 9/06

[52] U.S. Cl. ..... 395/2; 381/43

[58] Field of Search ..... 381/41-45, 381/47, 49, 50-51; 395/2

[56] References Cited

U.S. PATENT DOCUMENTS 4,829,573 5/1989 Gagnon et al. ..... 381/41

4,833,714 5/1989 Shimorani et al. ..... 381/43

*Primary Examiner*—Michael R. Fleming

*Assistant Examiner*—Michelle Doerrler

*Attorney, Agent, or Firm*—Mason, Fenwick & Lawrence

[57] ABSTRACT

A speech recognition apparatus includes a dictionary for storing information related to registered speeches for use in making a speech recognition, and a registration part for storing the infromation into the dictionary. The registration part includes a filter bank made up of first through nth filters and supplied with a speech which is to be registered in the dictionary, a first circuit part for generating recognition template information based on an output of the filter bank and for storing the recognition template information in the dictionary, and a second circuit part for generating pitch frequency information based on an output of the filter bank and for storing the pitch frequency information in the dictionary. The pitch frequency information is related to a frequency f which satisfies Min|A(f)|, where $$A(f) = \sum_j [(\partial/\partial f)X_j(f)][G_j - X_j(f)],$$

$X_j(f)$ denotes a theoretical filter gain of a jth filter of the filter bank at the frequency f, $G_j$ denotes a filter gain which is observed for the jth filter, and the pitch frequency is defined as a resonant frequency which is a most likely greatest common measure of filter gains of the first through nth filters of the filter bank.

18 Claims, 7 Drawing Sheets

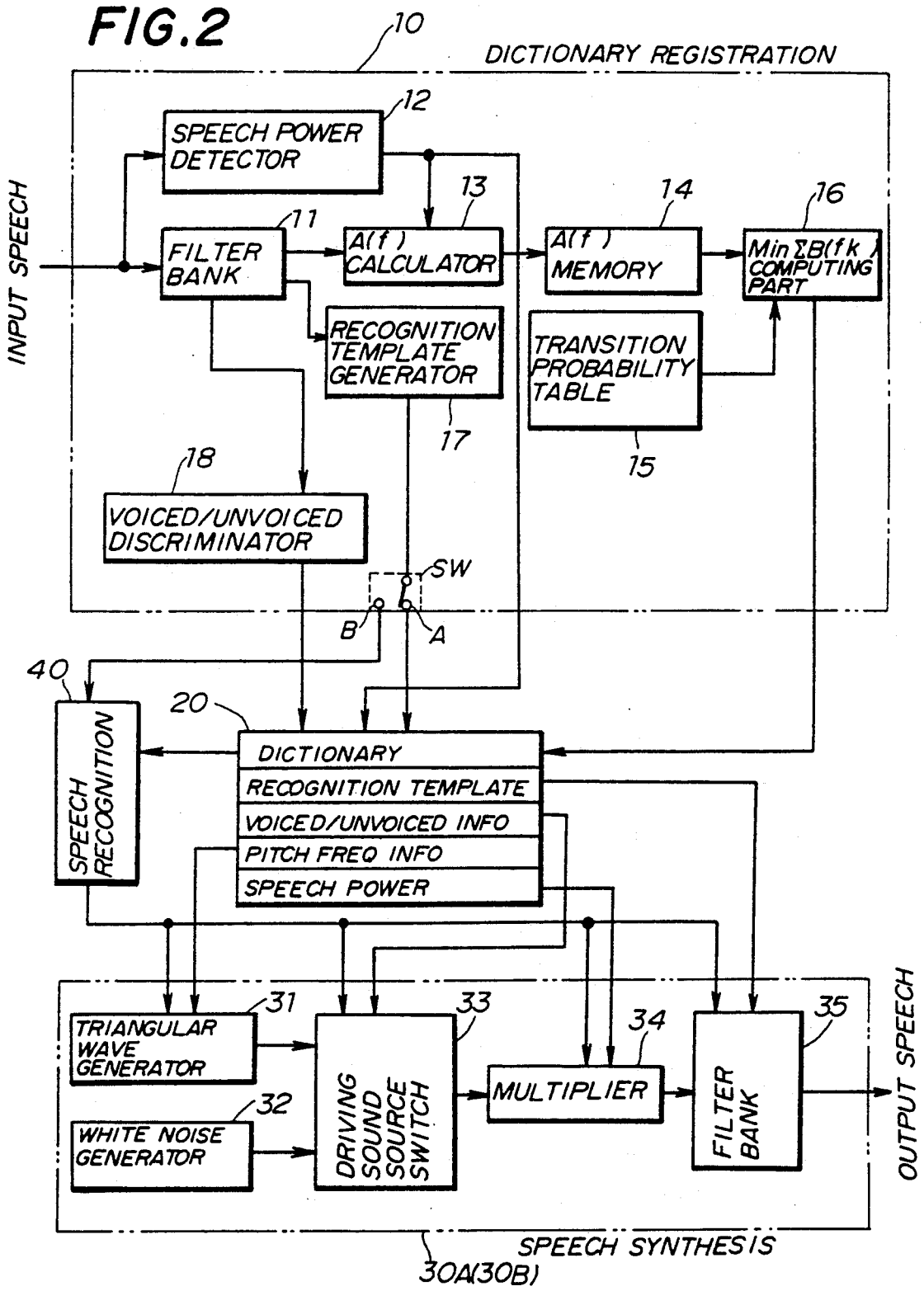
FIG.2
10
DICTIONARY REGISTRATION
12
SPEECH POWER DETECTOR
13
14
16
11
INPUT SPEECH
FILTER BANK
A(f) CALCULATOR
A(f) MEMORY
Min ΣB(fk) COMPUTING PART
RECOGNITION TEMPLATE GENERATOR
TRANSITION PROBABILITY TABLE
17
15
18
VOICED/UNVOICED DISCRIMINATOR
SW
B
A
40
20
SPEECH RECOGNITION
DICTIONARY
RECOGNITION TEMPLATE
VOICED/UNVOICED INFO
PITCH FREQ INFO
SPEECH POWER
31
33
34
35
TRIANGULAR WAVE GENERATOR
32
WHITE NOISE GENERATOR
DRIVING SOUND SOURCE SWITCH
MULTIPLIER
FILTER BANK
OUTPUT SPEECH
SPEECH SYNTHESIS
30A(30B)

SPEECH RECOGNITION APPARATUS USING PITCH EXTRACTION

BACKGROUND OF THE INVENTION

The present invention generally relates to speech recognition apparatuses, and more particularly to a speech recognition apparatus which makes a pitch extraction using a filter bank.

There is a proposed binary time spectrum pattern (BTSP) speech recognition system which carries out a linear matching between dictionary patterns and an input pattern which is obtained by subjecting a speech made in units of words to a binarization process. This proposed BTSP speech recognition system only requires a simple process because no dynamic programming (DP) matching is required. For this reason, the frequency deviation on the TSP can be absorbed satisfactorily, and is applicable to unspecified speakers.

On the other hand, a speech recognition system which uses a speech recognition dictionary and a speech synthesis dictionary in common is proposed in a Japanese Laid-Open Patent Application No. 63-502146, for example. However, according to this speech recognition system, there is a problem in that the synthesized speech does not have intonation or accent and sounds unnatural because the speech is generated with a constant pitch. Furthermore, when the BTSP is used for the speech recognition dictionary, there is another problem in that the volume (power) of the speech lacks smoothness.

SUMMARY OF THE INVENTION

Accordingly, it is a general object of the present invention to provide a novel and useful speech recognition apparatus in which the problems described above are eliminated.

Another and more specific object of the present invention is to provide a speech recognition apparatus which makes a speech recognition by collating an input speech with registered speeches, comprising a dictionary for storing information related to registered speeches for use in making a speech recognition, a registration part for storing the information into the dictionary in a dictionary registration mode, and a speech recognition part for collating an input speech with the registered speeches in the dictionary in a speech recognition mode and for outputting a recognition result. The registration part includes filter bank means including first through nth filters and supplied with a speech which is to be registered in the dictionary, first means for generating recognition template information based on an output of the filter bank means and for storing the recognition template information in the dictionary, and second means for generating pitch frequency information based on an output of the filter bank means and for storing the pitch frequency information in the dictionary. The pitch frequency information is related to a frequency f which satisfies Min|A(f)|, where $$A(f) = \sum_j [(\partial/\partial f)X_j(f)][G_j - X_j(f)],$$

$X_j(f)$ denotes a theoretical filter gain of a jth filter of the filter bank means at the frequency f, $G_j$ denotes a filter gain which is observed for the jth filter, and the pitch frequency is defined as a resonant frequency which is a most likely greatest common measure of filter gains of the first through nth filters of the filter bank means. According to the speech recognition apparatus of the present invention, it is possible to use the dictionary part in common for the speech recognition and for the speech synthesis. Further, it is unnecessary to provide a special hardware for detecting the pitch frequency from the waveform of the speech.

Still another object of the present invention is to provide the speech recognition apparatus as described above which further comprises a speech synthesis part for making a speech synthesis based on the pitch frequency information stored in the dictionary responsive to the recognition result from the speech recognition part. According to the speech recognition apparatus of the present invention, it is possible to generate by the speech synthesis a speech which has a natural intonation or accent.

Other objects and further features of the present invention will be apparent from the following detailed description when read in conjunction with the accompanying drawings.

BRIEF DESCRIPTION OF THE DRAWINGS

FIG. 2 is a system block diagram showing a second embodiment of the speech recognition apparatus according to the present invention;

DESCRIPTION OF THE PREFERRED EMBODIMENTS

Figure 1:
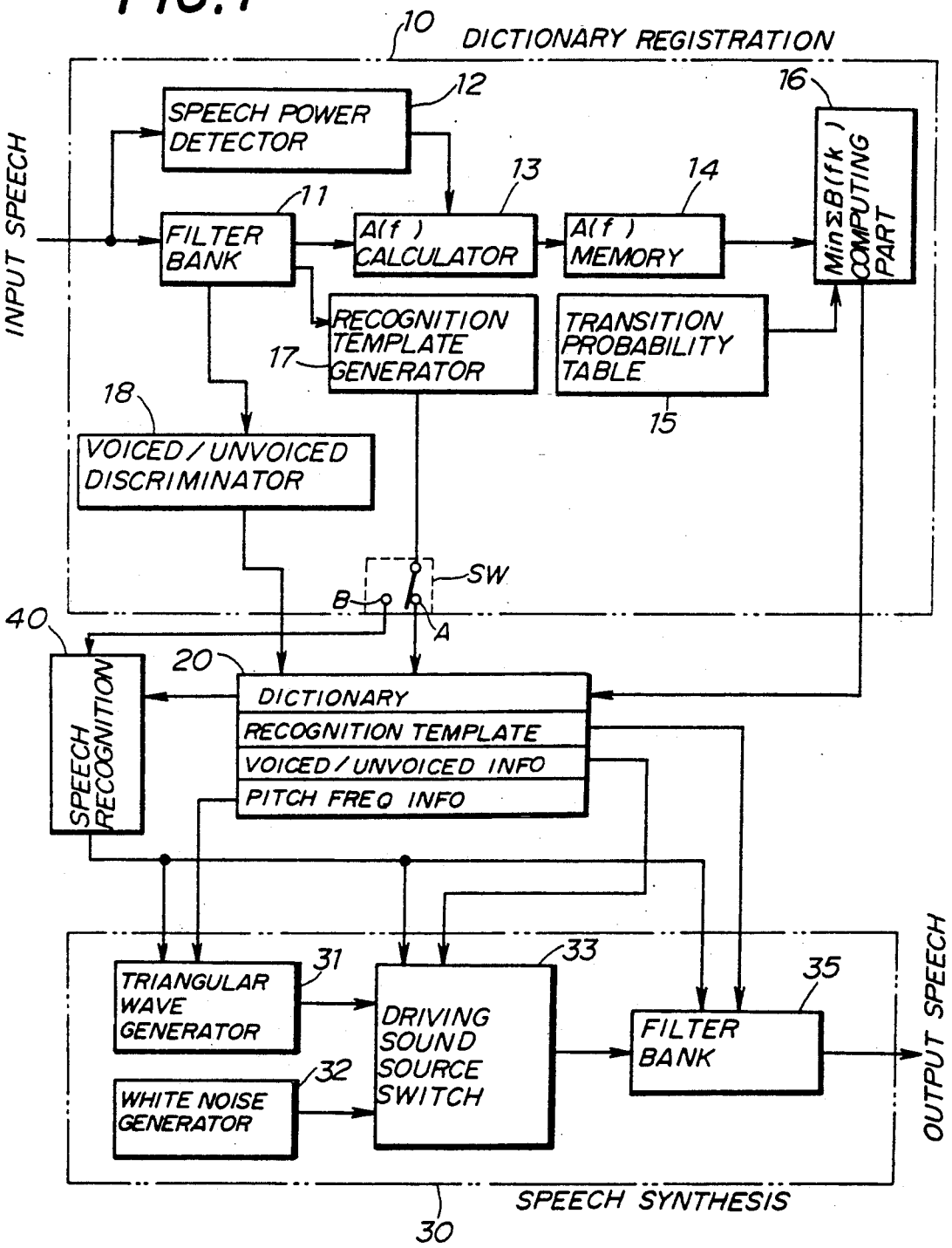
FIG. 1 is a system block diagram showing a first embodiment of a speech recognition apparatus according to the present invention.

A description will be given of a first embodiment of a speech recognition apparatus according to the present invention, by referring to FIG. 1. The speech recognition apparatus shown in FIG. 1 generally includes a dictionary registration part 10, a dictionary part 20, a speech synthesis part 30 and a speech recognition part 40.

The dictionary registration part 10 includes a filter bank 11, a speech power detector 12, an A(f) calculator 13, an A(f) memory 14, a transition probability table 15, a MinΣB(fk) computing part 16, a recognition template generator 17, a voiced/unvoiced discriminator 18, and a switch SW which are connected as shown.

The filter bank 11 is used for extracting a feature quantity of the speech and includes first through nth filters. The speech power detector 12 detects the power of an input speech. The A(f) calculator 13 calculates A(f) from an output level of a filter on the low frequency side of the filter bank 11 and an input level (speech power) of the filter. The A(f) memory 14 stores the A(f) which is calculated in the A(f) calculator 13. The transition probability table 15 contains the probability of making a transition from one pitch frequency to another pitch frequency for various pitch frequencies, and this transition probability table 15 is obtained beforehand. MinΣB(fk) computing part 16 obtains a most likely pitch frequency sequence by Viterbi Algorithm based on the contents of the A(f) memory 14 and the transition probability table 15. The recognition template generator 17 generates a speech recognition template from an output of the filter bank 11. For example, the recognition template generator 17 is a BTSP generator which generates the BTSP. The voiced/unvoiced discriminator 18 discriminates the voiced/unvoiced state. For example, the voiced/unvoiced discriminator 18 obtains a ratio between a level of an output of a filter on the low frequency side of the filter bank 11 and a level of a filter on the high frequency side of the filter bank 11, and discriminates the voiced state when this ratio is greater than a predetermined value and otherwise discriminates the unvoiced state. This filter on the low frequency side of the filter bank 11 may be different from the filter which is used when calculating the A(f).

The switch SW is connected to a terminal A during the dictionary registration and to a terminal B during the speech recognition.

The dictionary part 20 stores the voice recognition template, voiced/unvoiced information, pitch frequency and the like. For example, the BTSP is stored as the voice recognition template, and in this case, the dictionary part 20 also stores the speech power.

The speech synthesis part 30 includes a triangular wave generator 31, a white noise generator 32, a driving sound source switch 33, a multiplier 34, and a filter bank 35 which are connected as shown.

The triangular wave generator 31 is a driving sound source for the filter bank 35 in the voiced state, and the period of the generated triangular wave is determined by the pitch frequency of the frame. The white noise generator 32 is a driving sound source for the filter bank 35 in the unvoiced state. The driving source source switch 33 switches the driving sound source for the filter bank 35 depending on the voiced/unvoiced state. The multiplier 34 multiplies a desired speech power to the driving sound source. The filter bank 35 carries out a modeling of a vocal tract filter for the speech synthesis.

The speech recognition part 40 makes a speech recognition by collating the recognition template related to the input speech with the recognition templates registered in the dictionary part 20. The speech recognition part 40 drives the speech synthesis part 30 depending on the result of the speech recognition. Hence, when the speech recognition part 40 recognizes the input speech as "hello", for example, the speech recognition part 40 drives the speech synthesis part 30 to read out the registered information corresponding to the recognition result "hello" and generate therefrom the recognition result "hello". In other words, when the operator inputs the word "hello" by speech and the speech synthesis part 30 generates the word "hello", the operator can confirm that the word is correctly recognized by the speech recognition apparatus. The operation of collating the recognition template related to the input speech with the recognition templates registered in the dictionary part 20 is known, and a detailed description on the collating operation will be omitted in this specification.

The dictionary registration is carried out in the following sequence. The speech passes through the filter bank 11 and the speech power detector 12, and the A(f) calculator 13 calculates the A(f) which is described below based on the output of the filter on the low frequency side of the filter bank 11 and the speech power detected by the speech power detector 12.

$$A(f) = \sum_j [(\partial/\partial f)X_j(f)][G_j - X_j(f)]$$

The calculated A(f) is temporarily stored in the A(f) memory 14.

The recognition template generator 17 uses the output of the filter bank 11 to generate a recognition template, and this recognition template is stored in the dictionary part 20 via the switch SW. The voiced/unvoiced discriminator 18 discriminates the voiced/unvoiced state based on the output of the filter bank 11, and the voiced/unvoiced information from the voiced/unvoiced discriminator 18 is stored in the dictionary part 20.

On the other hand, the MinΣB(fk) computing part 16 calculates a fk sequence which satisfies MinΣB(fk) using the Viterbi Algorithm based on the values in the A(f) memory 14 and the transition probability table 15 and $B(fk) = A(fk) - \log P(fk \mid fk-1)$. The calculated fk sequence is stored in the dictionary part 20 as the pitch frequency. At this point in time, the dictionary registration is completed.

Next, a description will be given of the speech synthesis. The triangular wave generator 31 reads the pitch frequency information from the dictionary part 20 responsive to the recognition result from the speech recognition part 40 and generates a triangular wave having a period identical to the pitch frequency of a frame of the input speech. Based on the voiced/unvoiced information which is read from the dictionary part 20 responsive to the recognition result from the speech recognition part 40, the driving sound source switch 33 selectively outputs the triangular wave from the triangular wave generator 31 in the voiced state and the white noise from the white noise generator 32 in the unvoiced state. The driving sound source selected by the driving sound source switch 33 drives the filter bank 35 to make a speech synthesis. The characteristic of the filter bank 35 is determined by the recognition template which is read from the dictionary part 20 responsive to the recognition result from the speech recognition part 40.

Figure 3:
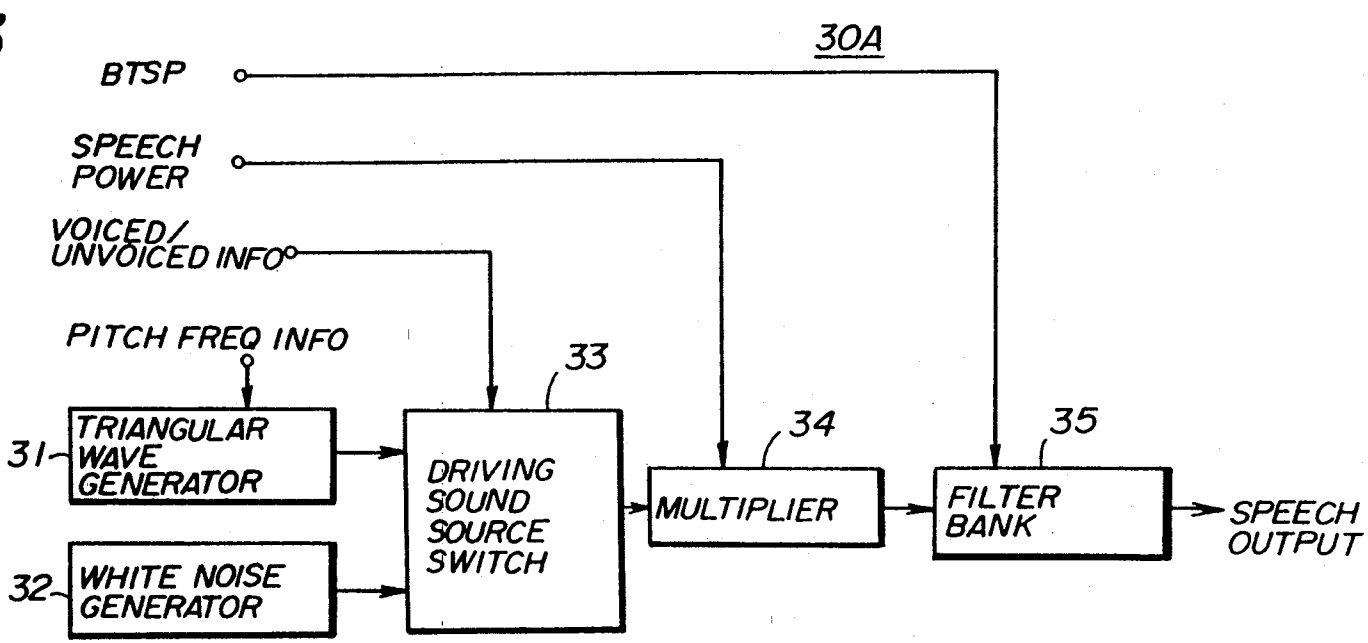
FIG. 3 is a system block diagram showing an essential part of the second embodiment shown in FIG. 2.
Figure 4:
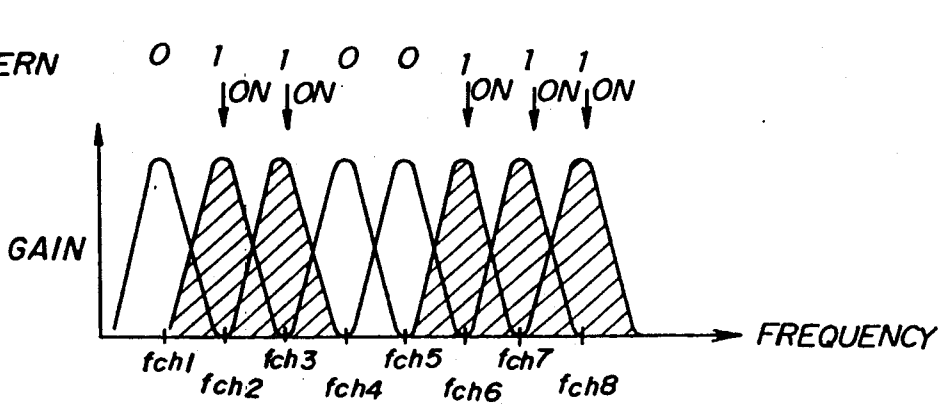
FIG. 4 is a diagram showing a relationship between a characteristic of a filter bank shown in FIG. 3 and BTSP.

Next, a description will be given of a second embodiment of the speech recognition apparatus according to the present invention, by referring to FIGS. 2 through 4. In FIG. 2, those parts which are essentially the same as those corresponding parts in FIG. 1 are designated by the same reference numerals, and a description thereof will be omitted. FIG. 3 shows an essential part of the second embodiment, that is, a speech synthesis part 30A. FIG. 4 is a diagram for explaining the relationship between the characteristic of the filter bank 35 and the BTSP.

In the second embodiment, the BTSP is used as the recognition template. In addition, the speech power is stored in the dictionary part 20 together with the BTSP.

In the speech synthesis part 30A, the triangular wave generator 31 reads the pitch frequency information from the dictionary part 20 responsive to the recognition result from the speech recognition part 40 and generates a triangular wave sequence having a period identical to the pitch frequency of the frame of the input speech. Based on the voiced/unvoiced information which is read from the dictionary part 20 responsive to the recognition result from the speech recognition part 40, the driving sound source switch 33 selectively outputs the triangular wave from the triangular wave generator 31 in the voiced state and the white noise from the white noise generator 32 in the unvoiced state. The multiplier 34 multiplies the speech power to the driving sound source selected by the driving sound source switch 33 and drives the filter bank 35 to make a speech synthesis. The multiplier 34 reads the speech power from the dictionary part 20 responsive to the recognition result from the speech recognition part 40. The characteristic of the filter bank 35 is determined by the BTSP shown in FIG. 4. The filter bank 35 reads the BTSP from the dictionary part 20 responsive to the recognition result from the speech recognition part 40. In FIG. 4, the hatched parts correspond to filters of the filter bank 35 which are turned ON (that is, made active) by the BTSP. In FIG. 4, Fch1 through Fch8 respectively denote center frequencies of eight bandpass filters making up the filter bank 35.

Figure 5:
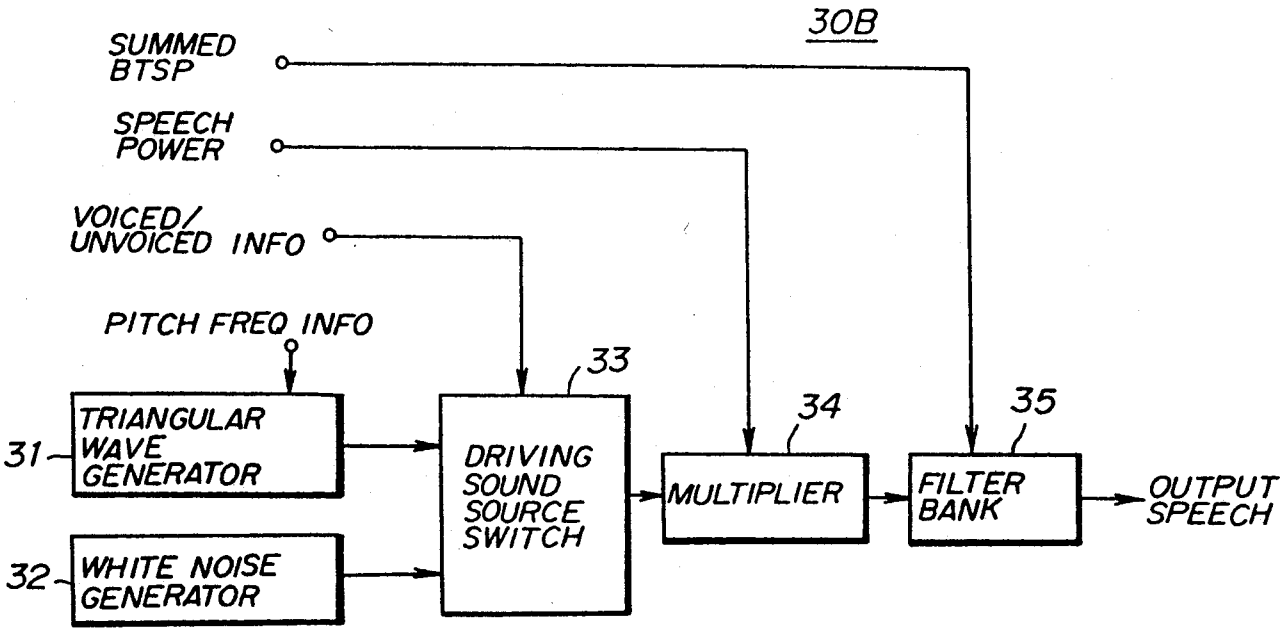
FIG. 5 is a system block diagram showing an essential part of a third embodiment of the speech recognition apparatus according to the present invention.
Figure 6:
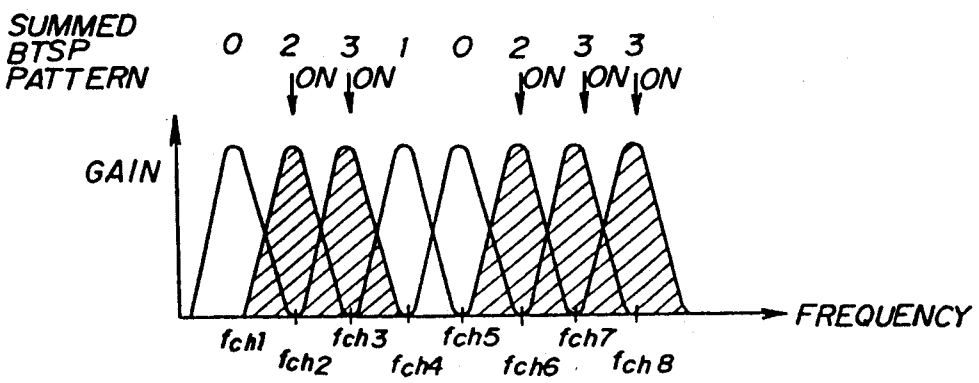
FIG. 6 is a diagram showing a relationship between a characteristic of a filter bank shown in FIG. 5 and summed BTSP.

Next, a description will be given of a third embodiment of the speech recognition apparatus according to the present invention, by referring to FIGS. 5 and 6. The same block system shown in FIG. 2 can be used in the third embodiment. FIG. 5 shows an essential part of the third embodiment, that is, a speech synthesis part 30B. In FIG. 5, those parts which are essentially the same as those corresponding parts in FIG. 2 are designated by the same reference numerals, and a description thereof will be omitted. FIG. 6 is a diagram for explaining the relationship between the characteristic of the filter bank 35 and the summed BTSP. In FIG. 6, it is assumed for the sake of convenience that the ON/OFF threshold value of the filters is "2".

In the third embodiment, the summed BTSP is used as the recognition template. In addition, the speech power is stored in the dictionary part 20 together with the BTSP.

In the speech synthesis part 30B, the triangular wave generator 31 reads the pitch frequency information from the dictionary part 20 responsive to the recognition result from the speech recognition part 40 and generates a triangular wave sequence having a period identical to the pitch frequency of the frame of the input speech. Based on the voiced/unvoiced information which is read from the dictionary part 20 responsive to the recognition result from the speech recognition part 40, the driving sound source switch 33 selectively outputs the triangular wave from the triangular wave generator 31 in the voiced state and the white noise from the white noise generator 32 in the unvoiced state. The multiplier 34 multiplies the speech power to the driving sound source selected by the driving sound source switch 33 and drives the filter bank 35 to make a speech synthesis. The multiplier 34 reads the speech power from the dictionary part 20 responsive to the recognition result from the speech recognition part 40. The characteristic of the filter bank 35 is determined by the summed BTSP shown in FIG. 6. The filter bank 35 reads the summed BTSP from the dictionary part 20 responsive to the recognition result from the speech recognition part 40. In FIG. 6, the hatched parts correspond to filters of the filter bank 35 which are turned ON by the summed BTSP, and the same designations are used as in FIG. 4.

Figure 7:
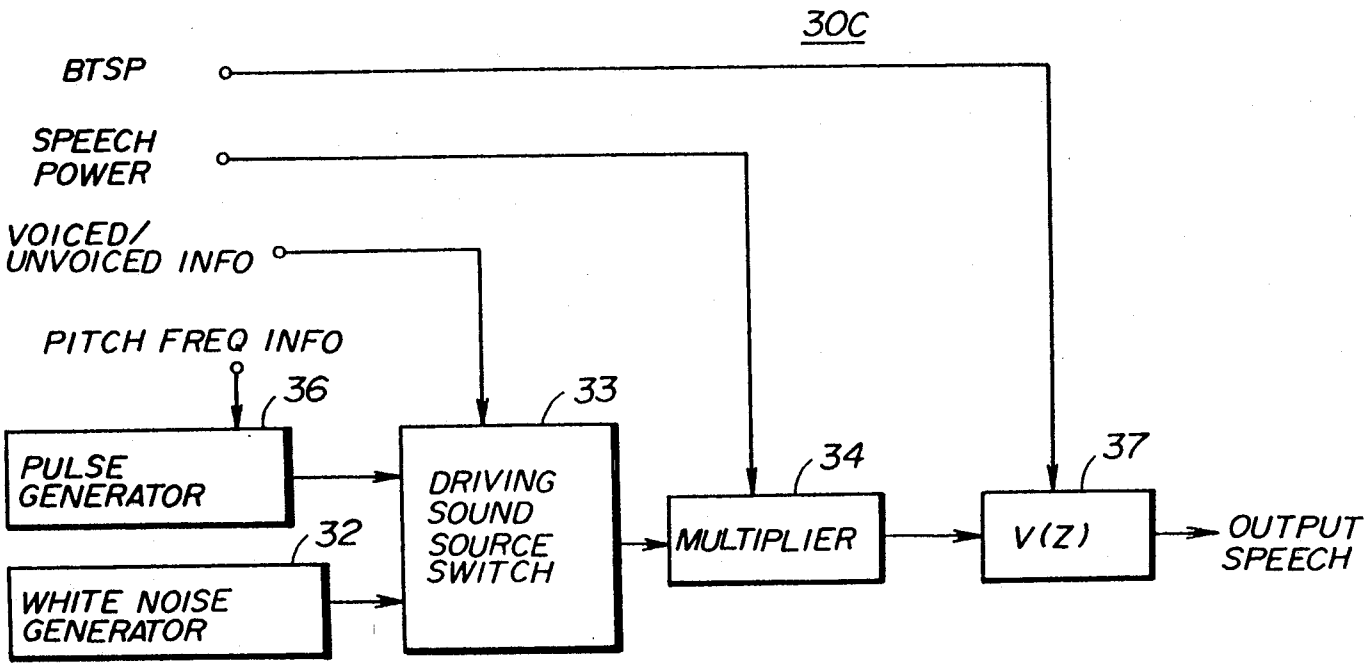
FIG. 7 is a system block diagram showing an essential part of a fourth embodiment of the speech recognition apparatus according to the present invention.
Figure 8:
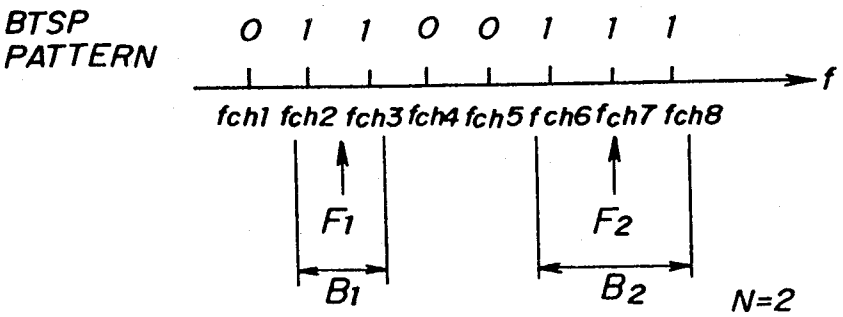
FIG. 8 is a diagram for explaining a relationship between Fi and Bi of a voice path filter characteristic V(z) and BTSP.

Next, a description will be given of a fourth embodiment of the speech recognition apparatus according to the present invention, by referring to FIGS. 7 and 8. The same block system shown in FIG. 2 can be used in the fourth embodiment, except for the structure of the speech synthesis part. FIG. 7 shows an essential part of the fourth embodiment, that is, a speech synthesis part 30C. In FIG. 7, those parts which are essentially the same as those corresponding parts in FIG. 2 are designated by the same reference numerals, and a description thereof will be omitted. FIG. 8 is a diagram for explaining the relationship between Fi and Bi of the voice path filter characteristic V(z) and the BTSP.

In the fourth embodiment, the BTSP is used as the recognition template. In addition, the speech power is stored in the dictionary part 20 together with the BTSP.

In the speech synthesis part 30C, a pulse generator 36 reads the pitch frequency information from the dictionary part 20 responsive to the recognition result from the speech recognition part 40 and generates a pulse sequence having a period identical to the pitch frequency of a frame of the input speech. Based on the voiced/unvoiced information read from the dictionary part 20 responsive to the recognition result from the speech recognition part 40, the driving sound source switch 33 selectively outputs the pulse from the pulse generator 36 in the voiced state and the white noise from the white noise generator 32 in the unvoiced state. The multiplier 34 multiplies the speech power to the driving sound source selected by the driving sound source switch 33 and drives a filter part 37 having the voice path filter characteristic V(z) to make a speech synthesis. The multiplier 34 reads the speech power from the dictionary part 20 responsive to the recognition result from the speech recognition part 40. The voice path filter characteristic V(z) of the filter part 37 is determined by the BTSP shown in FIG. 8. The filter part 37 reads the BTSP from the dictionary part 20 responsive to the recognition result from the speech recognition part 40. When an average of center frequencies of consecutive channels having a high level of BTSP during the speech synthesis is denoted by Fi and the bandwidth of the channels is denoted by Bi, the voice path filter characteristic V(z) can be described by the following formula, where Ai denotes a constant, N denotes a number of group in which the high level is consecutively obtained and T denotes a sampling time.

$$V(z) = \prod_{i=1}^{N} Ai/[1 - 2e^{-BIT}\cos(FiT)z^{-1} + e^{-zBiTz-z}]$$

Therefore, the filter part 37 is driven by the pulse sequence which has a power proportional to the speech power and having a period identical to the pitch frequency or the white noise having a power proportional to the speech power.

Figure 9:
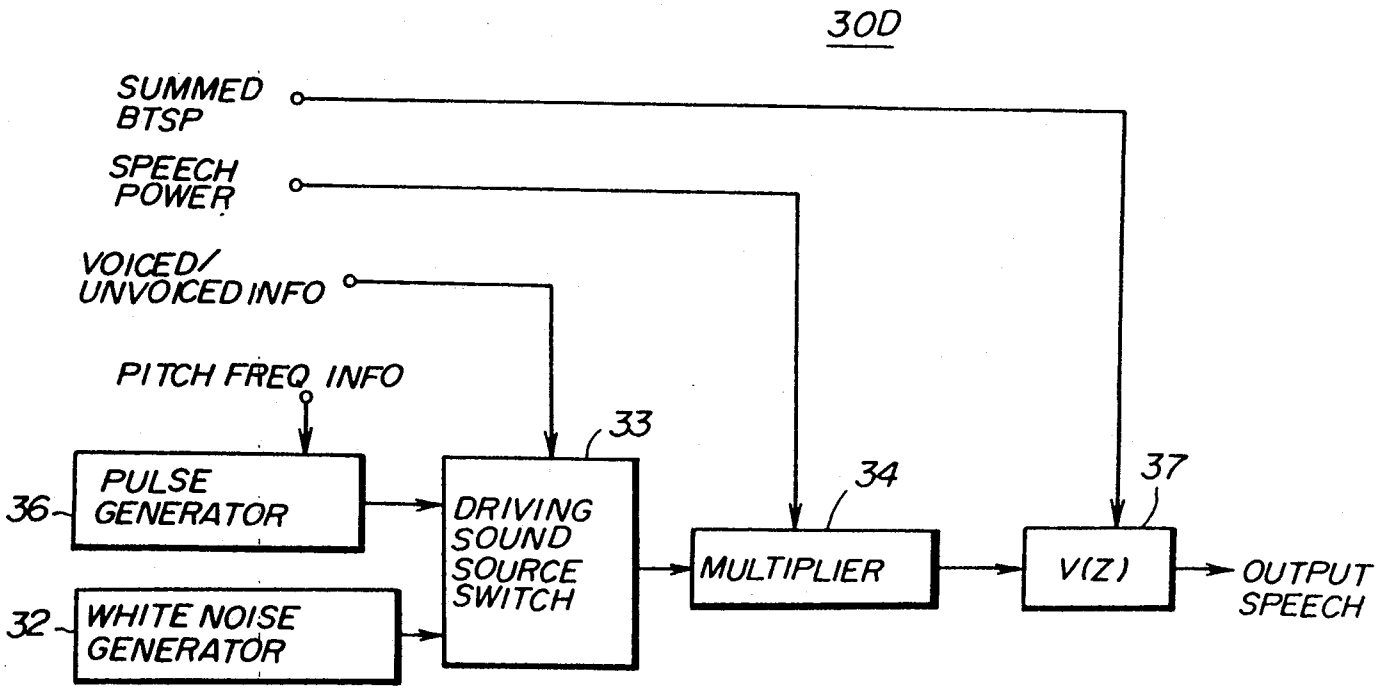
FIG. 9 is a system block diagram showing an essential part fifth embodiment of the speech recognition apparatus according to the present invention.
Figure 10:
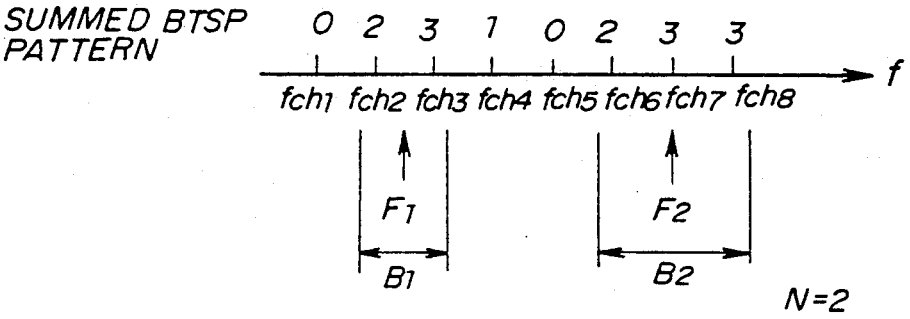
FIG. 10 is a diagram for explaining a relationship between Fi and Bi of a voice path filter characteristic V(z) and summed BTSP.

Next, a description will be given of a fifth embodiment of the speech recognition apparatus according to the present invention, by referring to FIGS. 9 and 10. The same block system shown in FIG. 2 can be used for the fifth embodiment. FIG. 9 shows an essential part of the fifth embodiment, that is, a speech synthesis part 30D. In FIG. 9, those parts which are essentially the same as those corresponding parts in FIG. 7 are designated by the same reference numerals, and a description thereof will be omitted. FIG. 10 is a diagram for explaining the relationship between Fi and Bi of the vocal tract filter characteristic V(z) and the summed BTSP. In FIG. 10, it is assumed for the sake of convenience that the ON/OFF threshold value is "2".

In the fifth embodiment, the summed BTSP is used as the recognition template. In addition, the speech power is stored in the dictionary part 20 together with the BTSP.

In the speech synthesis part 30D, the pulse generator 3 reads in the pitch frequency information from the dictionary part 20 responsive to the recognition result from the speech recognition part 40 and generates a pulse sequence having a period identical to the pitch frequency of the frame of the input speech. Based on the voiced/unvoiced information which is read from the dictionary part 20 responsive to the recognition result from the speech recognition part 40, the driving sound source switch 33 selectively outputs the pulse from the pulse generator 36 in the voiced state and the white noise from the white noise generator 32 in the unvoiced state. The multiplier 34 multiplies the speech power to the driving sound source selected by the driving sound source switch 33 and drives the filter part 37 having the voice path filter characteristic V(z) to make a speech synthesis. The multiplier 34 reads the speech power from the dictionary part 20 responsive to the recognition result from the speech recognition part 40. The voice path filter characteristic V(z) of the filter part 37 is determined by the summed BTSP shown in FIG. 10. The filter part 37 reads the summed BTSP from the dictionary part 20 responsive to the recognition result from the speech recognition part 40. When an average of center frequencies of consecutive channels having a level of summed BTSP greater than a predetermined level during the speech synthesis is denoted by Fi and the bandwidth of the channels is denoted by Bi, the voice path filter characteristic V(z) can be described by the following formula which is identical to the formula described above, where Ai denotes a constant, N denotes a number of groups in which the high level is consecutively obtained and T denotes a sampling time.

$$V(z) = \prod_{i=1}^{N} Ai/[1 - 2e^{-BIT}\cos(FiT)z^{-1} + e^{-zBiTz-z}]$$

Therefore, the filter part 37 is driven by the pulse sequence which has a power proportional to the speech power and having a period identical to the pitch frequency or the white noise having a power proportional to the speech power.

The driving sound source used in the first through third embodiments is different from the driving sound source used in the fourth and fifth embodiments. That is, the first through third embodiments use the filter bank 35, while the fourth and fifth embodiments use the filter part 37. Normally, the power of the voiced sound is concentrated in the low frequency region. In the first through third embodiments, the filter bank 35 has the same gain in each of the bands. Hence, the triangular wave is used as the driving sound source so as to describe the character of the voiced sound. On the other hand, the band width is generally narrow in the low frequency region. Accordingly, in the fourth and fifth embodiments, resonant circuits are coupled in a cascade connection to describe the character of the voiced sound.

Figure 11:
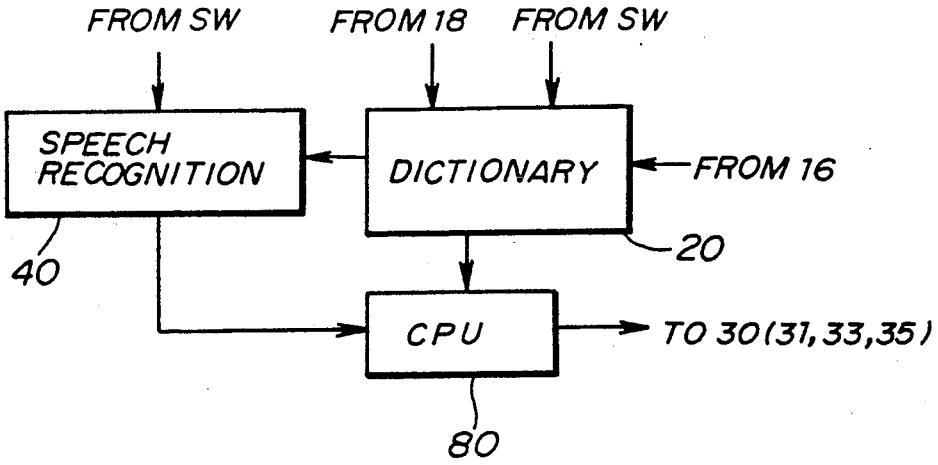
FIG. 11 is a system block diagram showing an essential part of a modification of the first embodiment.

FIG. 11 shows an essential part of a modification of the first embodiment. In FIG. 11, those parts which are essentially the same as those corresponding parts in FIG. 1 are designated by the same reference numerals, and a description thereof will be omitted. In FIG. 11, a central processing unit (CPU) 80 receives the recognition result from the speech recognition part 40 and reads out the necessary information from the dictionary part 20 to be supplied to various parts of the speech synthesis part 30.

It is apparent to those skilled in the art that the above described modification of the first embodiment can be applied similarly to the second through fifth embodiments.

Further, the present invention is not limited to these embodiments, but various variations and modifications may be made without departing from the scope of the present invention.

What is claimed is:

1. A speech recognition apparatus that operates by collating input speech patterns with registered speech patterns, the speech recognition apparatus operating in a dictionary registration mode and a speech recognition mode, the apparatus comprising:

a) a dictionary having information related to the registered speech patterns;

b) a registration part, to which the dictionary is responsive, the registration part storing the information into the dictionary in the dictionary registration mode, the registration part including:

1) a filter bank means including first through nth filters, the filter bank being supplied with speech patterns to be registered in the dictionary;

2) a recognition template generator, responsive to an output of the filter bank, the recognition template generator storing recognition template information into the dictionary; and 3) a pitch frequency information generator, responsive to an output of the filter bank, the pitch frequency information generator storing pitch frequency information into the dictionary, the pitch frequency information being related to a pitch frequency f which satisfies Min|A(f)|, wherein:

$$A(f) = \sum_j [(\partial/\partial f)X_j(f)][G_j - X_j(f)]; \quad \text{A)}$$

B) $X_j(f)$ denotes a theoretical filter gain of a jth filter of the filter bank at frequency f;

C) $G_j$ denotes a filter gain observed for the jth filter; and

D) the pitch frequency f is defined as a resonant frequency that is a most likely greatest common measure of filter gains of the first through nth filters; and c) a speech recognition part, responsive to an output of the dictionary, the speech recognition part collating the input speech patterns with the registered speech patterns in the dictionary in the speech recognition mode, the speech recognition part also outputting a speech recognition result.

2. The speech recognition apparatus as claimed in claim 1, wherein said pitch frequency information generator includes a calculator for calculating A(f) based on an output of an arbitrary filter of said filter bank means, a memory for temporarily storing the A(f) calculated by said calculator, a table for storing a probability of making a transition from one pitch frequency to another pitch frequency for various pitch frequencies, and a computing part for computing a most likely pitch frequency sequence f1, f2, . . . , fk which satisfies $\mathrm{Min}\Sigma B(fk)$ by Viterbi Algorithm based on the contents of said memory and said table, where $B(fk)=A(fk)-\log P(fk|fk-1)$, fk denotes a pitch frequency candidate for a kth frame, fk−1 denotes a pitch frequency candidate for a (k−1)th frame and P(fk|fk−1) denotes a probability that the pitch frequency makes a transition from fk−1 to fk.

3. The speech recognition apparatus as claimed in claim 2, wherein said arbitrary filter is located on a low frequency side of said filter bank means.

4. The speech recognition apparatus as claimed in claim 2, which further comprises a voice power detector for detecting a voice power of the speech which is to be registered and for storing voice power information in said dictionary.

5. The speech recognition apparatus as claimed in claim 4, wherein said recognition template generator generates time spectrum pattern information based on the output of said filter bank means and stores the time spectrum pattern information in said dictionary as the recognition template information.

6. The speech recognition apparatus as claimed in claim 5, wherein said recognition template generator generates binary time spectrum pattern information as the time spectrum pattern information.

7. The speech recognition apparatus as claimed in claim 2, which further comprises a voiced/unvoiced discriminator for discriminating voiced/unvoiced state based on an output of said filter bank means and for storing voiced/unvoiced information indicative of th discriminated voiced/unvoiced state in said dictionary.

8. The speech recognition apparatus as claimed in claim 1, which further comprises a speech synthesis part for making a speech synthesis based on the pitch frequency information stored in said dictionary responsive to the recognition result from said speech recognition part.

9. The speech recognition apparatus as claimed in claim 8, wherein said dictionary further stores voiced-/unvoiced information which describes a voiced/unvoiced state of speech, and said speech synthesis part includes:

a triangular wave generator for generating a triangular wave which has a period equal to a pitch frequency described by the pitch frequency information stored in said dictionary;

a white noise generator for generating a white noise;

a switch for selectively passing the triangular wave from said triangular wave generator in a voiced state and the white noise from said white noise generator in an unvoiced state responsive to the voiced/unvoiced information from said dictionary; and a filter bank coupled to said switch for receiving an output of said switch as a driving sound source and for outputting a synthesized speech, said filter bank having a characteristic which is determined by the recognition template information from said dictionary.

10. The speech recognition apparatus as claimed in claim 9, wherein said dictionary further stores voice power information which describes a voice power of speech, and said speech synthesis part further includes a multiplier coupled between said switch and said filter bank for multiplying to the output of said switch a coefficient which is determined by the voice power information from said dictionary, so that said filter bank receives one of a triangular wave and a white noise which has a power proportional to the voice power.

11. The speech recognition apparatus as claimed in claim 10, wherein said dictionary stores time spectrum pattern information as the recognition template information.

12. The speech recognition apparatus as claimed in claim 11, wherein said dictionary stores binary time spectrum pattern information as the time spectrum pattern information.

13. The speech recognition apparatus as claimed in claim 12, wherein said multiplier drives only those filters of said filter bank corresponding to channels in which a level of the binary time spectrum pattern information is greater than a predetermined level.

14. The speech recognition apparatus as claimed in claim 11, wherein said dictionary stores summed binary time spectrum pattern information as the time spectrum pattern information.

15. The speech recognition apparatus as claimed in claim 8, wherein said dictionary further stores voiced-/unvoiced information which describes a voiced/unvoiced state of speech and time spectrum pattern information is stored as the recognition template information, and said speech synthesis part includes:

a triangular wave generator for generating a triangular wave which has a period equal to a pitch frequency described by the pitch frequency information stored in said dictionary;

a white noise generator for generating a white noise;

a switch for selectively passing the triangular wave from said triangular wave generator in a voiced state and the white noise from said white noise generator in an unvoiced state responsive to the voiced/unvoiced information from said dictionary; and a filter part coupled to said switch for receiving an output of said switch as a driving sound source and for outputting a synthesized speech, said filter bank having a voice path characteristic V(z) which is determined by the time spectrum pattern information from said dictionary, said voice path characteristic V(z) being described by $$V(z) = \prod_{i=1}^{N} Ai/[1 - 2e^{-BIT}\cos(FiT)z^{-1} + e^{-zBiTz-z}]$$

where Fi denotes an average of center frequencies of consecutive channels having a level of the time spectrum pattern information greater than a predetermined level during the speech synthesis carried out by said speech synthesis part, Bi denotes a bandwidth the channels, Ai denotes a constant, N denotes a number of groups in which the high level is consecutively obtained, and T denotes a sampling time.

16. The speech recognition apparatus as claimed in claim 15, wherein said dictionary further stores voice power information which describes a voice power of speech, and said speech synthesis part further includes a multiplier coupled between said switch and said filter part for multiplying to the output of said switch a coefficient which is determined by the voice power information from said dictionary, so that said filter part receives one of a triangular wave and a white noise which has a power proportional to the voice power.

17. The speech recognition apparatus as claimed in claim 15, wherein said dictionary stores stores binary time spectrum pattern information as the time spectrum pattern information.

18. The speech recognition apparatus as claimed in claim 15, wherein said dictionary stores stores summed binary time spectrum pattern information as the time spectrum pattern information.

* * * * *